US010805755B1

(12) United States Patent
Tu et al.

(10) Patent No.: US 10,805,755 B1
(45) Date of Patent: Oct. 13, 2020

(54) SPEAKER ADJUSTMENT METHOD AND ELECTRONIC DEVICE USING THE SAME

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/681,832

(22) Filed: Nov. 13, 2019

(30) Foreign Application Priority Data

May 7, 2019 (TW) ..... 108115707 A

(51) Int. Cl.

| | |
|---|---|
| ***H04S 7/00*** | (2006.01) |
| ***H04R 1/40*** | (2006.01) |
| ***H04R 3/00*** | (2006.01) |
| ***H04R 5/02*** | (2006.01) |
| ***H04S 1/00*** | (2006.01) |
| ***H04R 3/12*** | (2006.01) |
| ***H04R 29/00*** | (2006.01) |

(52) U.S. Cl.
CPC ..... *H04S 7/301* (2013.01); *H04R 1/406* (2013.01); *H04R 3/005* (2013.01); *H04R 3/12* (2013.01); *H04R 5/02* (2013.01); *H04R 29/005* (2013.01); *H04S 1/007* (2013.01); *H04S 2400/15* (2013.01)

(58) Field of Classification Search
CPC ..... H04S 7/301; H04S 1/007; H04S 2400/13; H04S 2400/15; H04R 3/12; H04R 3/005; H04R 5/02; H04R 1/406; H04R 5/04; H04R 29/005
USPC ..... 381/92, 59, 303, 58, 103, 26, 56, 94.2, 381/98, 122, 91, 101, 322, 332, 334, 381/71.11, 80
See application file for complete search history.

(56) References Cited

U.S. PATENT DOCUMENTS

2009/0055170 A1* 2/2009 Nagahama ..... G10L 15/20 704/226
2015/0208184 A1* 7/2015 Tan ..... H04R 3/04 381/58

* cited by examiner

*Primary Examiner* — Norman Yu
(74) *Attorney, Agent, or Firm* — JCIPRNET

(57) ABSTRACT

A speaker adjustment method applicable to an electronic device including two microphones and two speakers is provided. The speaker adjustment method includes the following steps: obtaining two first frequency responses corresponding the two speakers by using one microphone, and obtaining two second frequency responses corresponding the two speakers by using another microphone; calculating a sensitivity difference between the two microphones according to the two first frequency responses and the two second frequency responses, where a distance ratio of distances from the two microphones to one speaker equals to a distance ratio of distances from the two microphones to another speaker; and adjusting outputs of the two speakers according to the sensitivity difference, at least one of the first frequency responses and at least one of the second frequency responses. In addition, an electronic device using the speaker adjustment method is also provided.

20 Claims, 3 Drawing Sheets

SPEAKER ADJUSTMENT METHOD AND ELECTRONIC DEVICE USING THE SAME

CROSS-REFERENCE TO RELATED APPLICATION

This application claims the priority benefit of Taiwan application serial no. 108115707, filed on May 7, 2019. The entirety of the above-mentioned patent application is hereby incorporated by reference herein and made a part of this specification.

BACKGROUND OF THE DISCLOSURE

Field of the Disclosure

The present disclosure relates to a speaker adjusting technique, and more particularly to a speaker adjustment method for adjusting a plurality of speakers by using a plurality of microphones and an electronic device using the same.

Description of Related Art

In today's dual-channel mobile device, although the sound outlet of the speaker is arranged at two symmetrical ends, since a tolerance of ±3 dB between individual speakers is allowed in the mass production, and there are differences in the design of mechanism in the mobile device, inconsistency often occurs in the frequency response of the left and right channel signals of the mobile device, which causes the sound field to deviate from the center of the mobile device. For example, when the frequency response of the left channel is greater than the frequency response of the right channel, the sound field is deviated to the left; otherwise, when the frequency response of the right channel is greater than the left channel, the sound field is deviated to the right.

SUMMARY OF THE DISCLOSURE

In view of the above, an embodiment of the present disclosure provides a speaker adjustment method and an electronic device using the same, which can well adjust the outputs of a plurality of speakers by using two microphones, so that the plurality of speakers can reach a target sound field during broadcasting.

The speaker adjustment method of the embodiment of the present disclosure is adapted for an electronic device including two microphones and two speakers. The speaker adjustment method includes the steps of: obtaining a first left frequency response corresponding to a first speaker and a first right frequency response corresponding to a second speaker by using a first microphone, and obtaining a second left frequency response corresponding to the first speaker and a second right frequency response corresponding to the second speaker by using a second microphone; calculating a sensitivity difference between the first microphone and the second microphone according to the first left frequency response, the first right frequency response, a second left frequency response and a second right frequency response, wherein a distance ratio of distances from the first microphone and the second microphone to the first speaker is equal to a distance ratio of distances from the second microphone and the first microphone to the second speaker; and adjusting the outputs of the first speaker and the second speaker according to the sensitivity difference, at least one of the first left frequency response and the first right frequency response and at least one of the second left frequency response and the second right frequency response.

The electronic device of the embodiment of the disclosure includes a first speaker, a second speaker, a first microphone, a second microphone, and a processor. The first speaker and the second speaker are configured to broadcast a frequency scanning signal. The first microphone is configured to respectively receive a first left channel signal and a first right channel signal when the first speaker and the second speaker broadcast the frequency scanning signal. The second microphone is configured to respectively receive a second left channel signal and a second right channel signal when the first speaker and the second speaker broadcast the frequency scanning signal. A distance ratio of the distances from the first microphone and the second microphone to the first speaker is equal to a distance ratio of the distances from the second microphone and the first microphone to the second speaker. The processor is coupled to the first speaker, the second speaker, the first microphone, and the second microphone, and configured to: respectively obtain a first left frequency response, a first right frequency response, a second left frequency response, and a second right frequency response according to the first left channel signal, the first right channel signal, the second left channel signal, and the second right channel signal; calculate a sensitivity difference between the first microphone and the second microphone according to the first left frequency response, the first right frequency response, the second left frequency response, and the second right frequency response; and adjust the outputs of the first speaker and the second speaker according to the sensitivity difference, at least one of the first left frequency response and the first right frequency response and at least one of the second left frequency response and the second right frequency response.

Based on the above, the speaker adjustment method and the electronic device using the same described in the embodiments of the present disclosure use two microphones to respectively obtain two frequency responses of two speakers, and then adjust the outputs of the two speakers according to the frequency responses. Specifically, the distance ratio of distances from the two microphones to one of the speakers is equal to the distance ratio of distances from the two microphones to the other speaker, so the sensitivity difference between the two microphones can be calculated based on the obtained multiple frequency responses, thereby calibrating the obtained frequency response according to the sensitivity difference. Such speaker adjustment method does not need to take into account the volume influence caused by the different distances between the microphone and the plurality of speakers, and can eliminate individual differences between the plurality of microphone units to achieve good sound field adjustment.

In order to make the aforementioned features and advantages of the disclosure more comprehensible, embodiments accompanying figures are described in detail below.

DESCRIPTION OF EMBODIMENTS

The speaker adjustment method in the embodiment of the present disclosure adjusts the outputs of two speakers by using two microphones. In detail, there might be a sensitivity difference between the two microphones due to the tolerance of the mechanism and so on, but when the distance ratio of distances from the two microphones to one speaker is equal to the distance ratio of distances from the two microphones to the other speaker, the sensitivity difference between the two microphones can be calculated through the sound respectively received by the two microphones corresponding to the two speakers. In this manner, through the speaker adjustment method in the embodiment of the present disclosure, even if there are sensitivity differences between the two microphones for adjusting the two speakers, a good adjustment result can be obtained.

In the following descriptions, the speaker adjustment method will be described with an electronic device provided with two speakers and two microphones. However, it should be noted that the present disclosure is not limited thereto, and the proposed speaker adjustment method can also be applied to other audio systems or electronic systems such as a movie theater, a home theater and so on.

Figure 1A:
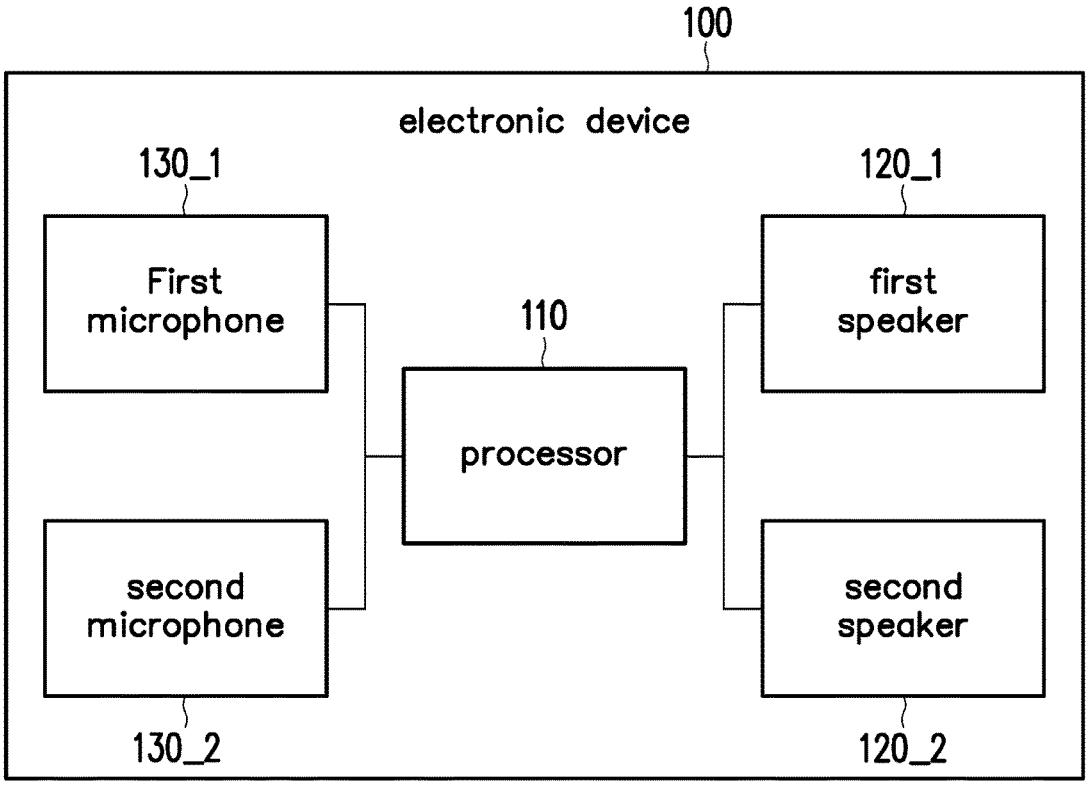
FIG. 1A is a schematic block diagram of an electronic device according to an embodiment of the disclosure.
Figure 1B:
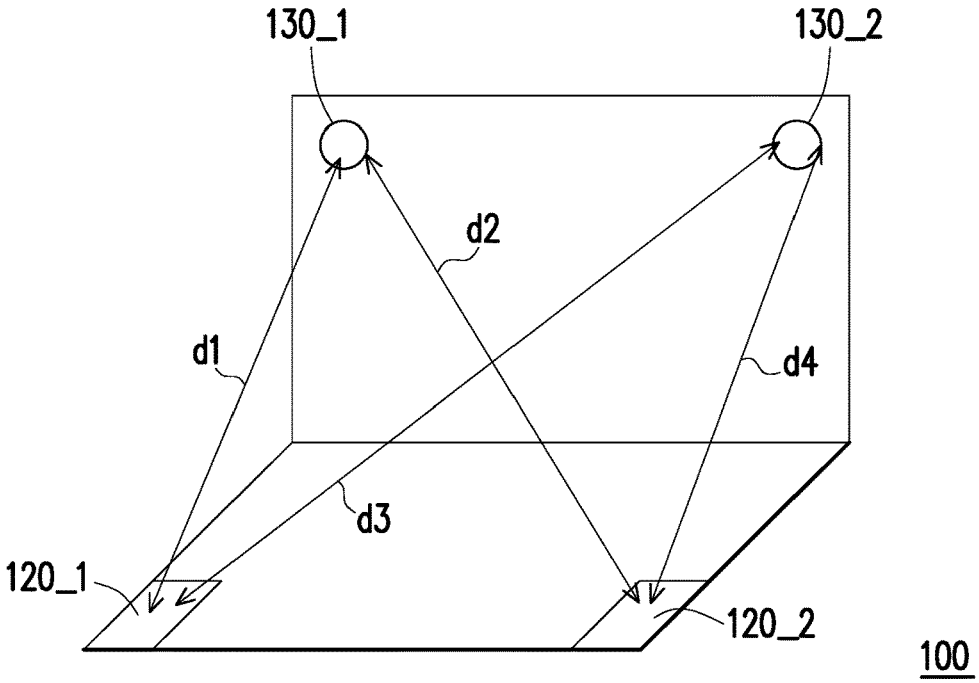
FIG. 1B is a schematic view of an electronic device according to an embodiment of the disclosure.

FIG. 1A is a schematic block diagram of an electronic device according to an embodiment of the disclosure. FIG. 1B is a schematic view of an electronic device according to an embodiment of the disclosure.

Referring to FIG. 1A, in the embodiment, an electronic device 100 includes, for example, a processor 110, a first speaker 120_1, a second speaker 120_2, a first microphone 130_1, and a second microphone 130_2, wherein the first speaker 120_1, the second speaker 120_2, the first microphone 130_1 and the second microphone 130_2 are coupled to the processor 110. It should be noted that two speakers and two microphones are exemplified in this embodiment, but as long as the number of the speaker and the microphone is not less than two, the present disclosure provides no limitation to the number of speakers and microphones.

The processor 110 is, for example, a dual core, quad core, or eight core central processing unit (CPU), a system-on-chip (SOC), an application processor, a media processor, a microprocessor, a digital signal processor, a programmable controller, an application specific integrated circuit (ASIC), a programmable logic device (PLD) or other similar device or a combination of these devices, the present disclosure is not limited thereto.

For convenience of description, the first speaker 120_1 and the second speaker 120_2 in the following description respectively refer to the sound outlet positions of the left channel and the right channel of the electronic device 100, and the positions of the first microphone 130_1 and the second microphone 130_2 respectively refer to the sound inlet positions on the left side and right side of the electronic device 100.

In this embodiment, the distance between the first speaker 120_1 and the first microphone 130_1 is, for example, a first distance d1; the distance between the first speaker 120_1 and the second microphone 130_2 is, for example, a second distance d2; the distance between the second speaker 120_2 and the first microphone 130_1 is, for example, a third distance d3; the distance between the second speaker 120_2 and the second microphone 130_2 is, for example, a fourth distance d4. Specifically, when the speaker transmits audio signals to microphones at different distances, the volume influence caused by the distance difference is associated with the distance ratio. Therefore, the ratio of the first distance d1 to the second distance d2 is designed to be the same as the ratio of the fourth distance d4 to the third distance d3, so that the same speaker has the same volume influence on the two microphones.

Referring to FIG. 1B, in the embodiment, the electronic device 100 is, for example, a lifting cover electronic device, and includes an upper cover and a lower base that can be opened/closed with respect to each other. For example, the upper cover can be configured to set a display panel (not shown) of the electronic device 100, and the lower base can be configured to set the processor 110, the memory (not shown) and so on of the electronic device 100, the disclosure is not limited thereto. The electronic device 100 is bilaterally symmetrical with respect to the reference surface, the first speaker 120_1 and the second speaker 120_2 are symmetrically disposed on the lower base of the electronic device 100 with respect to the reference surface, and the first microphone 120_1 and the second microphone 130_2 are symmetrically fixed on the upper cover of the electronic device 100 with respect to the reference surface. However, in other embodiments, the electronic device 100 may also be a non-lifting cover electronic device, and the present disclosure is not limited thereto.

In this embodiment, the first distance d1 from the first speaker 120_1 to the first microphone 130_1 is equal to the fourth distance d4 from the second speaker 120_2 to the second microphone 130_2, and the second distance d2 from the first speaker 120_1 to the second microphone 130_2 is equal to the third distance d3 from the second speaker 120_2 to the first microphone 130_1, but the disclosure is not limited thereto. The processor 110 is responsible for performing a speaker adjustment method to adjust the first speaker 120_1 and/or the second speaker 120_2 so that the sound field of the electronic device 100 is maintained in the middle.

Figure 2:
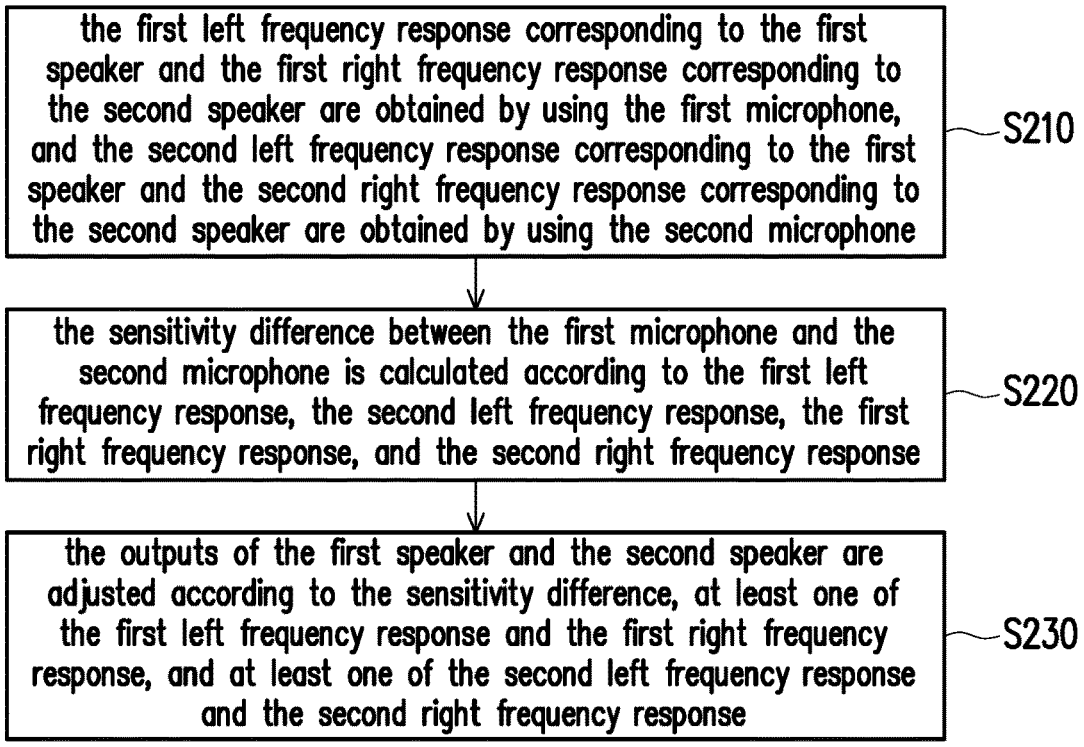
FIG. 2 is a flow chart of a speaker adjustment method according to an embodiment of the present disclosure.

FIG. 2 is a flow chart of a speaker adjustment method according to an embodiment of the present disclosure.

The speaker adjustment method of the present embodiment is adapted to the electronic device 100 in FIG. 1A and FIG. 1B, and therefore will be described below with reference to the electronic device 100. However, it should be understood that the speaker adjustment method of this embodiment can also be adapted to other audio systems or electronic systems, and is not limited to the electronic device 100.

Referring to FIG. 2, in step S210, the first left frequency response corresponding to the first speaker 120_1 and the first right frequency response corresponding to the second speaker 120_2 are obtained by using the first microphone 130_1, and the second left frequency response corresponding to the first speaker 120_1 and the second right frequency response corresponding to the second speaker 120_2 are obtained by using the second microphone 130_2. Specifically, each speaker will separately broadcast a frequency scanning signal, and the microphones respectively receive the audio signals when each of the speakers broadcasts the frequency scanning signal to obtain the frequency response of each speaker. The frequency scanning signal is, for example, a signal of which the amplitude does not change but the frequency changes, and those having ordinary skill in the art can understand the meaning of the frequency scanning signal, so related descriptions are not incorporated herein.

In this embodiment, the processor 110 first broadcasts the frequency scanning signal through the first speaker 120_1. The first microphone 130_1 receives the first left channel signal when the first speaker 120_1 broadcasts the frequency scanning signal, so the processor 110 can obtain the first left frequency response corresponding to the first speaker 120_1 accordingly. Then, the processor 110 broadcasts the same frequency scanning signal through the second speaker 120_2. The first microphone 130_1 receives the first right channel signal when the second speaker 120_2 broadcasts the frequency scanning signal, so the processor 110 can obtain the first right frequency response corresponding to the second speaker 120_2 accordingly. On the other hand, when the processor 110 broadcasts the frequency scanning signal through the first speaker 120_1, the second microphone 130_2 receives the second left channel signal when the first speaker 120_1 broadcasts the frequency scanning signal, so the processor 110 can obtain the second left frequency response corresponding to the first speaker 120_1 accordingly. In addition, when the processor 110 broadcasts the same frequency scanning signal through the second speaker 120_2, the second microphone 130_2 receives the second right channel signal when the second speaker 120_2 broadcasts the frequency scanning signal, so the processor 110 can obtain the second right frequency response corresponding to the second speaker 120_2 accordingly.

It should be mentioned that although in the present embodiment, the first distance d1 between the first microphone 130_1 and the first speaker 120_1 is the same as the fourth distance d4 between the second microphone 130_2 and the second speaker 120_2, the volume influence caused by the distance can be ignored. However, since there might be a sensitivity difference between the first microphone 130_1 and the second microphone 130_2, if the speaker is adjusted directly according to the first left frequency response corresponding to the first speaker 120_1 and the second right frequency response corresponding to the second speaker 120_2, such adjustment method will result in a misalignment result due to the sensitivity difference between the first microphone 130_1 and the second microphone 130_2.

In step S220, the sensitivity difference between the first microphone 130_1 and second microphone 130_2 is calculated according to the first left frequency response, the second left frequency response, the first right frequency response, and the second right frequency response. Specifically, when the distance ratio of distances from two microphones to one of the speakers is the same as the distance ratio of distances from the two microphones to the other speaker, it means that each speaker has the same volume influence on the two microphones, so the sensitivity difference between the two microphones can be calculated through the four frequency responses obtained by the two microphones corresponding to the two speakers.

Figure 3:
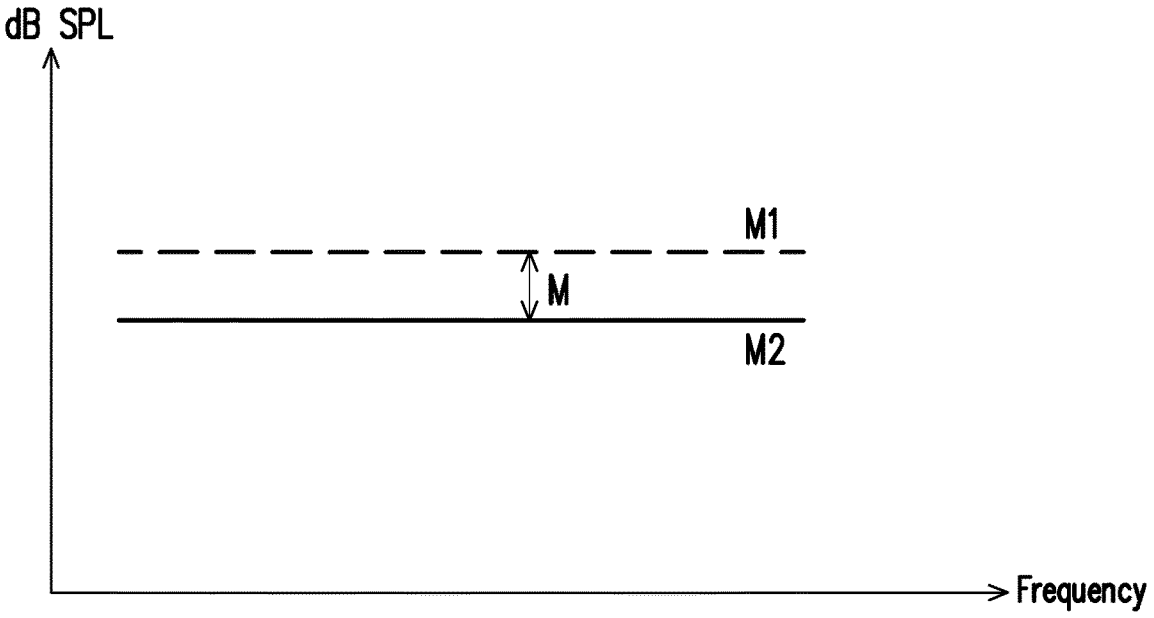
FIG. 3 is a schematic view of a sensitivity difference between microphones according to an embodiment of the disclosure.

FIG. 3 is a schematic view of a sensitivity difference between microphones according to an embodiment of the disclosure.

Referring to FIG. 3, in the embodiment, the first microphone 130_1 has, for example, a first sensitivity M1, and the second microphone 130_2 has, for example, a second sensitivity M2, and the sensitivity difference M between the first microphone 130_1 and the second microphone 130_2 is, for example, the first sensitivity M1 minus the second sensitivity M2. Therefore, the first left frequency response and the second left frequency response corresponding to the first speaker 120_1 satisfy the following relationship equation:

$$L1=L2+M+D$$

Specifically, L1 is the first left frequency response corresponding to the first speaker 120_1, L2 is the second left frequency response corresponding to the first speaker 120_1, and D is the volume influence caused by the ratio of the first distance d1 between the first speaker 120_1 and the first microphone 130_1 to the second distance d2 between the first speaker 120_1 and second microphone 130_2.

Specifically, since the ratio of the fourth distance d4 between the second speaker 120_2 and the second microphone 130_2 to the third distance d3 between the second speaker 120_2 and the first microphone 130_2 is the same as the ratio of the first distance d1 to the second distance d2, the volume influence caused by the ratio of the fourth distance d4 to the third distance d3 will also be D. Therefore, the first right frequency response and the second right frequency response corresponding to the second speaker 120_2 satisfy the following relationship equation:

$$R2+M=R1+D.$$

Specifically, R1 is the first right frequency response corresponding to the second speaker 120_1, and R2 is the second right frequency response corresponding to the second speaker 120_2. Based on the above two relationship equations, the sensitivity difference M can be calculated:

$$M=0.5(L1+R1-L2-R2).$$

In this manner, even if the actual first sensitivity M1 of the first microphone 130_1 and the actual second sensitivity M2 of the second microphone 130_2 are unknown, the processor 110 can calculate the sensitivity difference M between the first microphone 130_1 and the second microphone 130_2 according to the first left frequency response L1, the first right frequency response R1, the second left frequency response L2 and the second right frequency response R2.

In step S230, the outputs of the first speaker 120_1 and the second speaker 120_2 are adjusted according to the sensitivity difference between the first microphone 130_1 and the second microphone 130_2, at least one of the first left frequency response and the first right frequency response, and at least one of the second left frequency response and the second right frequency response. Specifically, after knowing the sensitivity difference between the two microphones, the sensitivity difference can be used to calibrate the frequency response obtained by the two microphones. For example, if the sensitivity of the first microphone 130_1 is higher than the sensitivity of the second microphone 130_2 by the sensitivity difference M, the processor 110 may decrease the magnitude (decibel) of the frequency response obtained by the first microphone 130_1 and/or increases the magnitude (decibel) of the frequency response obtained by the second microphone 130_2 according to the sensitivity difference M, thereby eliminating the volume influence caused by the sensitivity difference M between the first microphone 130_1 and the second microphone 130_2.

In order to adjust the outputs of the two speakers, first it is required to calibrate at least one frequency response corresponding to each speaker. In this embodiment, since the first distance d1 is equal to the fourth distance d4, and the second distance d2 is equal to the third distance d3, the processor 110 may, for example, select the first left frequency response corresponding to the first speaker 120_1 and the second right frequency response corresponding to the second speaker 120_2 to perform calibration according to the sensitivity difference to eliminate the volume influence caused by the sensitivity difference between the first microphone 130_1 and the second microphone 130_2, or select the second left frequency response corresponding to the first speaker 120_1 and the first right frequency response corresponding to the second speaker 120_2 to perform calibration according to the sensitivity difference to eliminate the volume influence caused by sensitivity difference between the first microphone 130_1 and the second microphone 130_2. Specifically, with such selection, the distance between the speaker and the microphone can be ignored.

Figure 4:
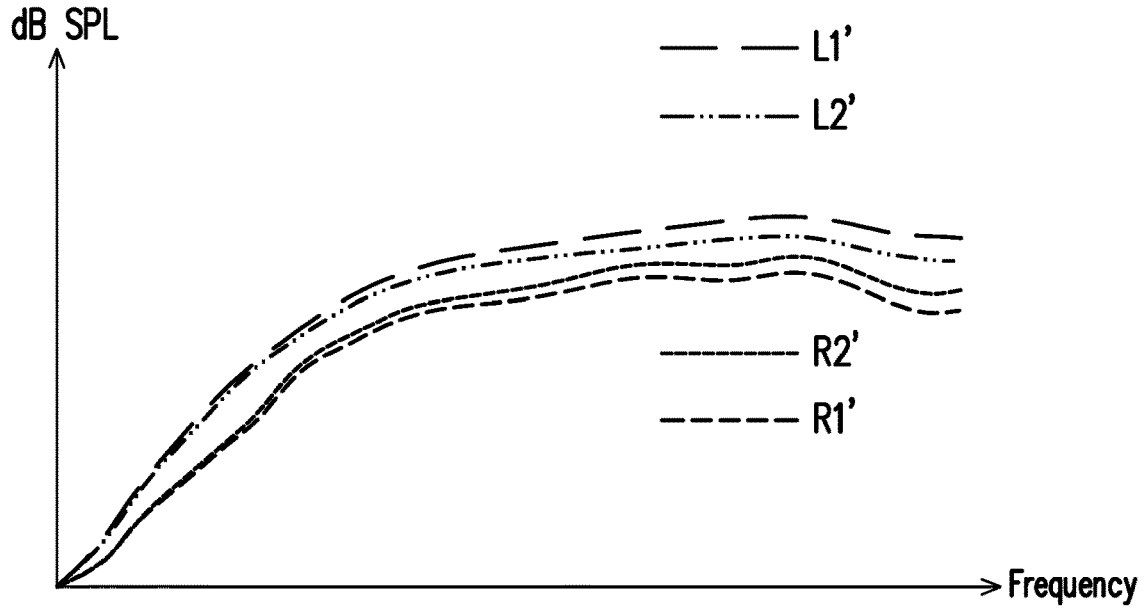
FIG. 4 is a schematic diagram showing a frequency response of a speaker according to an embodiment of the disclosure.

FIG. 4 is a schematic diagram showing a frequency response of a speaker according to an embodiment of the disclosure.

Referring to FIG. 4, if the processor 110 selects the first left frequency response corresponding to the first speaker 120_1 and the second right frequency response corresponding to the second speaker 120_2 to perform calibration according to the sensitivity difference, then a calibrated first left frequency response L1' corresponding to the first speaker 120_1 and a calibrated second right frequency response R2' corresponding to the second speaker 120_2 are obtained, for example. It should be noted that the calibrated first left frequency response L1' is still different from the calibrated second right frequency response R2'. Such phenomenon may be caused by the difference between mechanical designs of the first speaker 120_1 and the second speaker 120_2 or component layout of the electronic device 100 and so on. Based on the above, the processor 110 can adjust the outputs of the first speaker 120_1 and the second speaker 120_2 according to the calibrated first left frequency response L1' and the calibrated second right frequency response R2', thereby adjusting the sound field symmetry of the electronic device 100.

Similarly, if the processor 110 selects the second left frequency response corresponding to the first speaker 120_1 and the first right frequency response corresponding to the second speaker 120_2 to perform calibration according to the sensitivity difference, then a calibrated second left frequency response L2' corresponding to the first speaker 120_1 and a calibrated first right frequency response R1' corresponding to the second speaker 120_2 are obtained, for example. It should be noted that the calibrated second left frequency response L2' is still different from the calibrated first right frequency response R1'. Such phenomenon may be caused by the difference between mechanical designs of the first speaker 120_1 and the second speaker 120_2 or component layout of the electronic device 100 and so on. Based on the above, the processor 110 can adjust the outputs of the first speaker 120_1 and the second speaker 120_2 according to the calibrated second left frequency response L2' and the calibrated first right frequency response R1', thereby adjusting the sound field symmetry of the electronic device 100.

In the following description, it is exemplified that the processor 110 adjusts the outputs of the first speaker 120_1 and the second speaker 120_2 according to the calibrated first left frequency response L1' and the calibrated second right frequency response R2'. Other situations can be deduced based on the above and will not be repeated in the following description.

Figure 5:
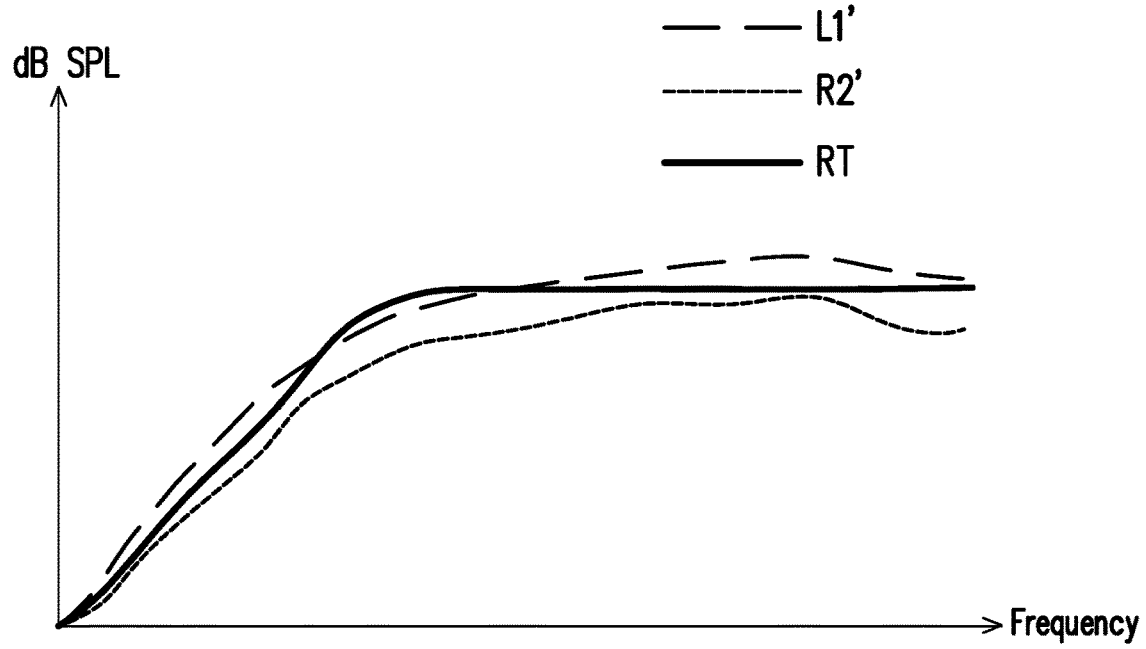
FIG. 5 is a schematic diagram showing a target frequency response according to an embodiment of the present disclosure.

FIG. 5 is a schematic diagram showing a target frequency response according to an embodiment of the present disclosure.

Referring to FIG. 5, FIG. 5 illustrates the calibrated first left frequency response L1 the calibrated second right frequency response R2', and the target frequency response RT. In this embodiment, in order to balance the sound field of the electronic device 100, the processor 110 determines, for example, a target frequency response RT to adjust the outputs of the first speaker 120_1 and the second speaker 120_2 according to the determined target frequency response RT so as to adjust the calibrated first left frequency response L1' and the calibrated second right frequency response R2' toward the target frequency response RT.

The target frequency response RT may be relevant or irrelevant to frequency responses such as the first left frequency response, the first right frequency response, the second left frequency response, and the second right frequency response obtained in step S210. In some embodiments, the target frequency response RT can be predefined by the user. In some embodiments, the target frequency response RT may be determined by the processor 110 according to the calibrated first left frequency response L1' and the calibrated second right frequency response R2'. For example, the processor 110 may select one of the calibrated first left frequency response L1' and the calibrated second right frequency response R2' as the target frequency response RT. In another example, the processor 110 may calculate the target frequency response RT by means of the average and/or moving average according to the calibrated first left frequency response L1' and the calibrated second right frequency response R2'. In other words, the present disclosure provides no limitation to the specific determining method of the target frequency response RT, and those having ordinary skill in the art can implement the determining method depending on the needs.

In this embodiment, when adjusting the outputs of the plurality of speakers, the processor 110 adjusts, for example, an equalizer (EQ) corresponding to the first speaker 120_1 and the second speaker 120_2 to adjust the calibrated first left frequency response L1' and the calibrated second right frequency response R2' toward the target frequency response RT. In this way, the electronic device 100 can have a symmetric and balanced sound field when broadcasting audio through the first speaker 120_1 and the second speaker 120_2.

It should be mentioned that the present disclosure provides no limitation to the specific adjustment items when adjusting the outputs of the plurality of speakers. In addition to the equalizer corresponding to each speaker, the outputs of the speakers can also be adjusted by means of Fast Fourier Transform (FFT) or wavelet transform.

In summary, the speaker adjustment method and the electronic device using the same described in the embodiments of the present disclosure use two microphones to respectively obtain two frequency responses of two speakers, and then adjust the outputs of the two speakers according to the frequency responses. Specifically, the distance ratio of distances from the two microphones to one of the speakers is equal to the distance ratio of distances from the two microphones to the other speaker, so the sensitivity difference between the two microphones can be calculated based on the obtained multiple frequency responses, thereby calibrating the obtained frequency response according to the sensitivity difference. Such speaker adjustment method does not need to take into account the volume influence caused by the different distances between the microphone and the plurality of speakers, and can eliminate individual differences between the plurality of microphone units to achieve good sound field adjustment.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A speaker adjustment method adapted for an electronic device, wherein the electronic device comprises two microphones and two speakers, and the speaker adjustment method comprising:

obtaining, by using a first microphone, a first left frequency response corresponding to a first speaker and a first right frequency response corresponding to a second speaker, and obtaining, by using a second microphone, a second left frequency response corresponding to the first speaker and a second right frequency response corresponding to the second speaker;

calculating a sensitivity difference between the first microphone and the second microphone according to the first left frequency response, the first right frequency response, the second left frequency response and the second right frequency response, wherein a distance ratio of distances from the first microphone and the second microphone to the first speaker is equal to a distance ratio of distances from the second microphone and the first microphone to the second speaker; and adjusting outputs of the first speaker and the second speaker according to the sensitivity difference, at least one of the first left frequency response and the first right frequency response and at least one of the second left frequency response and the second right frequency response.

2. The speaker adjustment method according to claim 1, wherein the step of obtaining, by using a first microphone, a first left frequency response corresponding to a first speaker and a first right frequency response corresponding to a second speaker, and obtaining, by using a second microphone, a second left frequency response corresponding to the first speaker and a second right frequency response corresponding to the second speaker comprises:

respectively broadcasting a frequency scanning signal by the first speaker and the second speaker, so as to generate a plurality of audio signals; and receiving the plurality of audio signals from the first speaker and the second speaker by the first microphone and the second microphone, so as to obtaining the first left frequency response, the first right frequency response, the second left frequency response and the second right frequency response.

3. The speaker adjustment method according to claim 1, wherein the first microphone and the second microphone are symmetrically disposed with respect to a reference surface of the electronic device, and the first speaker and the second speaker are symmetrically disposed with respect to the reference surface of the electronic device.

4. The speaker adjustment method according to claim 3, wherein a distance from the first microphone to the first speaker is equal to a distance from the second microphone to the second speaker, and a distance from the first microphone to the second speaker is equal to a distance from the second microphone to the first speaker.

5. The speaker adjustment method according to claim 1, wherein the step of adjusting the outputs of the first speaker and the second speaker according to the sensitivity difference, the at least one of the first left frequency response and the first right frequency response and the at least one of the second left frequency response and the second right frequency response comprises:

calibrating the first left frequency response and the second right frequency response, or calibrating the first right frequency response and the second left frequency response according to the sensitivity difference; and adjusting the outputs of the first speaker and the second speaker to adjust the calibrated first left frequency response and the calibrated second right frequency response, or the calibrated first right frequency response and the calibrated second left frequency response toward a target frequency response.

6. The speaker adjustment method according to claim 1, wherein the step of adjusting outputs of the first speaker and the second speaker according to the sensitivity difference, at least one of the first left frequency response and the first right frequency response and at least one of the second left frequency response and the second right frequency response comprises:

adjusting at least one of a magnitude of the frequency response obtained by the first microphone and a magnitude of the frequency response obtained by the second microphone according to the sensitivity difference.

7. The speaker adjustment method according to claim 1, wherein the step of adjusting the outputs of the first speaker and the second speaker according to the sensitivity difference, the at least one of the first left frequency response and the first right frequency response and the at least one of the second left frequency response and the second right frequency response comprises:

determining a target frequency response according to the at least one of the first left frequency response and the first right frequency response and the at least one of the second left frequency response and the second right frequency response; and adjusting the outputs of the first speaker and the second speaker according to the target frequency response, the sensitivity difference, the at least one of the first left frequency response and the first right frequency response and the at least one of the second left frequency response and the second right frequency response.

8. The speaker adjustment method according to claim 7, wherein the step of determining a target frequency response according to the at least one of the first left frequency response and the first right frequency response and the at least one of the second left frequency response and the second right frequency response comprises:

calculating average or moving average of the at least one of the first left frequency response and the first right frequency response and the at least one of the second left frequency response and the second right frequency response to obtain the target frequency response.

9. The speaker adjustment method according to claim 1, wherein the step of adjusting the outputs of the first speaker and the second speaker according to the sensitivity difference, the at least one of the first left frequency response and the first right frequency response and the at least one of the second left frequency response and the second right frequency response comprises:

adjusting an equalizer of the first speaker and the second speaker.

10. The speaker adjustment method according to claim 1, wherein the step of adjusting outputs of the first speaker and the second speaker according to the sensitivity difference, at least one of the first left frequency response and the first right frequency response and at least one of the second left frequency response and the second right frequency response comprises:

adjusting the outputs of the first speaker and the second speaker by using Fast Fourier Transform (FFT) or wavelet transform.

11. An electronic device, comprising:

a first speaker, configured to broadcast a frequency scanning signal;

a second speaker, configured to broadcast the frequency scanning signal;

a first microphone, configured to respectively receive a first left channel signal and a first right channel signal when the first speaker and the second speaker broadcast the frequency scanning signal;

a second microphone, configured to respectively receive a second left channel signal and a second right channel signal when the first speaker and the second speaker broadcast the frequency scanning signal, wherein a distance ratio of distances from the first microphone and the second microphone to the first speaker is equal to a distance ratio of distances from the second microphone and the first microphone to the second speaker; and a processor, coupled to the first speaker, the second speaker, the first microphone and the second microphone, configured to:

obtain a first left frequency response, a first right frequency response, a second left frequency response and a second right frequency response respectively according to the first left channel signal, the first right channel signal, the second left channel signal and the second right channel signal;

calculate a sensitivity difference between the first microphone and the second microphone according to the first left frequency response, the first right frequency response, the second left frequency response and the second right frequency response; and adjust outputs of the first speaker and the second speaker according to the sensitivity difference, at least one of the first left frequency response and the first right frequency response and at least one of the second left frequency response and the second right frequency response.

12. The electronic device according to claim 11, wherein the first microphone and the second microphone are symmetrically disposed with respect to a reference surface of the electronic device, and the first speaker and the second speaker are symmetrically disposed with respect to the reference surface of the electronic device.

13. The electronic device according to claim 12, wherein a distance from the first microphone to the first speaker is equal to a distance from the second microphone to the second speaker, and a distance from the first microphone to the second speaker is equal to a distance from the second microphone to the first speaker.

14. The electronic device according to claim 11, wherein the first microphone and the second microphone are symmetrically disposed on an upper cover of the electronic device with respect to a reference surface of the electronic device, and the first speaker and the second speaker are symmetrically disposed on an lower cover of the electronic device with respect to the reference surface of the electronic device.

15. The electronic device according to claim 11, wherein in the operation of adjusting the outputs of the first speaker and the second speaker according to the sensitivity difference, the at least one of the first left frequency response and the first right frequency response and the at least one of the second left frequency response and the second right frequency response, the processor is configured to:

calibrate the first left frequency response and the second right frequency response, or calibrate the first right frequency response and the second left frequency response according to the sensitivity difference; and adjust the outputs of the first speaker and the second speaker to adjust the calibrated first left frequency response and the calibrated second right frequency response, or the calibrated first right frequency response and the calibrated second left frequency response toward a target frequency response.

16. The electronic device according to claim 11, wherein in the operation of adjusting outputs of the first speaker and the second speaker according to the sensitivity difference, at least one of the first left frequency response and the first right frequency response and at least one of the second left frequency response and the second right frequency response, the processor is configured to:

adjust at least one of a magnitude of the frequency response obtained by the first microphone and a magnitude of the frequency response obtained by the second microphone according to the sensitivity difference.

17. The electronic device according to claim 11 wherein in the operation of adjusting the outputs of the first speaker and the second speaker according to the sensitivity difference, the at least one of the first left frequency response and the first right frequency response and the at least one of the second left frequency response and the second right frequency response, the processor is configured to:

determine a target frequency response according to the at least one of the first left frequency response and the first right frequency response and the at least one of the second left frequency response and the second right frequency response; and adjust the outputs of the first speaker and the second speaker according to the target frequency response, the sensitivity difference, the at least one of the first left frequency response and the first right frequency response and the at least one of the second left frequency response and the second right frequency response.

18. The electronic device according to claim 11, wherein in the operation of determining a target frequency response according to the at least one of the first left frequency response and the first right frequency response and the at least one of the second left frequency response and the second right frequency response, the processor is configured to:

calculate average or moving average of the at least one of the first left frequency response and the first right frequency response and the at least one of the second left frequency response and the second right frequency response to obtain the target frequency response.

19. The electronic device according to claim 11, wherein in the operation of adjusting the outputs of the first speaker and the second speaker according to the sensitivity difference, the at least one of the first left frequency response and the first right frequency response and the at least one of the second left frequency response and the second right frequency response, the processor is configured to:

adjust an equalizer of the first speaker and the second speaker.

20. The electronic device according to claim 11, wherein in the operation of adjusting outputs of the first speaker and the second speaker according to the sensitivity difference, at least one of the first left frequency response and the first right frequency response and at least one of the second left frequency response and the second right frequency response, the processor is configured to:

adjust the outputs of the first speaker and the second speaker by using Fast Fourier Transform (FFT) or wavelet transform.

* * * * *